US005870783A

United States Patent [19]

Stoll et al.

[11] Patent Number: 5,870,783

[45] Date of Patent: Feb. 16, 1999

[54] KITCHEN SINK

[75] Inventors: Elmar Stoll, Wolfwil; Melchior Lanz, Grünen-Summiswald; Fritz Berchtold, Schlossrued; Max Ris, Wangen bei Olten; Martin Bolli, Rothrist, all of Switzerland

[73] Assignee: Niro-Plan AG, Zug, Switzerland

[21] Appl. No.: 896,379

[22] Filed: Jul. 18, 1997

[30] Foreign Application Priority Data

Jul. 24, 1996 [DE] Germany ..... 196 29 840.7

[51] Int. Cl.[6] ..... A47K 1/04

[52] U.S. Cl. ..... 4/619; 4/660

[58] Field of Search ..... 4/619, 630, 631, 4/632, 633, 634, 635, 639, 660, 636

[56] References Cited

U.S. PATENT DOCUMENTS

| | | | |
|---|---|---|---|
| 2,759,196 | 8/1956 | Schuck | 4/660 |
| 2,784,418 | 3/1957 | Luoman . | |
| 3,034,150 | 5/1962 | Lyon | 4/635 |
| 3,196,466 | 7/1965 | Lorenzo | 4/633 |
| 3,365,732 | 1/1968 | Juergens et al. | 4/634 |
| 3,555,577 | 1/1971 | Drain | 4/660 |

FOREIGN PATENT DOCUMENTS

| | | | |
|---|---|---|---|
| 524428 | 5/1956 | Canada | 4/636 |
| 1 360 364 | 12/1964 | France . | |
| 2 283 265 | 3/1976 | France . | |
| 320 538 | 2/1975 | Germany . | |
| 295 01 235 | 6/1995 | Germany . | |
| 44 39 906 | 11/1995 | Germany . | |

*Primary Examiner*—David J. Walczak
*Attorney, Agent, or Firm*—Panitch Schwarze Jacobs & Nadel, P.C.

[57] ABSTRACT

A kitchen sink with a frame and at least one basin are prefabricated as separate parts. For the connection between frame and basin(s), one of the two parts has undercut zones and the connection takes place through pressing the other part into an undercut zones mentioned, or into an interference fitting area.

14 Claims, 2 Drawing Sheets

KITCHEN SINK

BACKGROUND OF THE INVENTION

The invention is based on a metallic kitchen sink with an elevated surrounding edge area, which functions as a frame, and at least one basin, wherein the frame and the basin are prefabricated as separate parts and then joined with each other.

Such kitchen sinks are chiefly manufactured as add-in sinks, so that they can be inserted into an appropriate opening of a work plate. In the same way, these kitchen sinks can also, however, be manufactured in the form of a complete panel which replaces the work plate. In addition to the one basin further basins, of various sizes if desired, can be installed. Usually at least one drip element is also integrated into the sink.

With the construction described in the introduction, where the frame and the basin are produced separately, it is necessary to weld the basin into the frame, from which very expensive after-finishing results. Above all, the welding areas over the entire perimeter of the welded-in basin must be ground and polished, especially brushed. Frequently, the entire sink is also brushed. These jobs are associated with a high expenditure in time and money, and are also problematic with regard to environmental pollution owing to the harmful substances resulting from the grinding and polishing.

In addition, it is also known, to manufacture the sink from a single plate in a deep drawing process, so that welding-in the various basins becomes unnecessary. The deep drawing process, however, has the following disadvantages: First, the freedom of configuration is greatly restricted; particularly the depth and shape of the basin are limited because the ductility of the steel sheet is restricted. Second, for reasons of drawing technology, a relatively large radius must be maintained in the transition from basin to frame, as must a certain flange width between adjacent basins.

BRIEF SUMMARY OF THE INVENTION

Proceeding from this, underlying the present invention is the object of developing a sink, especially of stainless steel, which on the one hand allows the configuration freedom of multipart sinks, but on the other hand avoids the expensive welding and subsequent smoothing and brushing.

This object is accomplished in accordance with the invention in that the frame and the basin are pressed together along surrounding overlapping joining surfaces with the formation of at least one interference fit.

The press fit technique described guarantees a tight and stable connection between basin and frame, without having to rely on expensive welding-in with subsequent grinding and brushing.

In order to assure a correct transition between basin edge and frame, it is recommended that the pressed-together joining surfaces run continuously around the entire perimeter of the basin. Here, the interference fit can be formed either by an undersize of the connecting surfaces of the frame in relation to the corresponding connecting surfaces of the basin to be located therein, or the reverse through an oversize of the connecting surface of the basin in relation to the connecting surfaces of the frame located around the outside of the basin.

The stability of the press connection of the invention can be further increased by providing several connecting surfaces at a distance from one another or variously directed connecting surfaces with interference fitting between frame and basin. The stability can be increased in the same way by at least one interference fit being supplemented by undercut zones in the connecting area of the frame or the basin.

The connecting surfaces responsible for the interference fit preferably run approximately vertically, because the basin is inserted into the frame in this direction.

With respect to the constructive configuration, it is recommended that the connecting surfaces be formed by an upper basin flange running approximately horizontally, on the one hand, and by a supporting surface of the frame, on the other, which supports the basin flange laterally and underneath, whereby at least the basin flange is braced with its outer edge in an interference fit with the frame.

Furthermore, it is recommended that the mentioned supporting surface of the frame run to a downwardly projecting centering flange which is braced against the basin wall. This way, inserting and fixing the basin in the frame are improved.

The desired connection becomes especially stable if the basin outer edge is braced latchably from above in a surrounding undercut of the frame. This undercut is accommodated in a vertically bent area of the frame corresponding to the basin outer edge and at the same time ensures a clean transition between basin outer edge and the frame.

In order that the connection between basin and frame is absolutely tight, an adhesive and/or sealing compound is positioned in the overlapping area, especially pressed in with them.

BRIEF DESCRIPTION OF THE SEVERAL VIEWS OF THE DRAWING

The foregoing summary, as well as the following detailed description of a preferred embodiment of the invention, will be better understood when read in conjunction with the appended drawings. For the purpose of illustrating the invention, there is shown in the drawings an embodiment which is presently preferred. It should be understood, however, that the invention is not limited to the precise arrangements and instrumentalities shown. In the drawings.

DETAILED DESCRIPTION OF THE INVENTION

Figure 1:
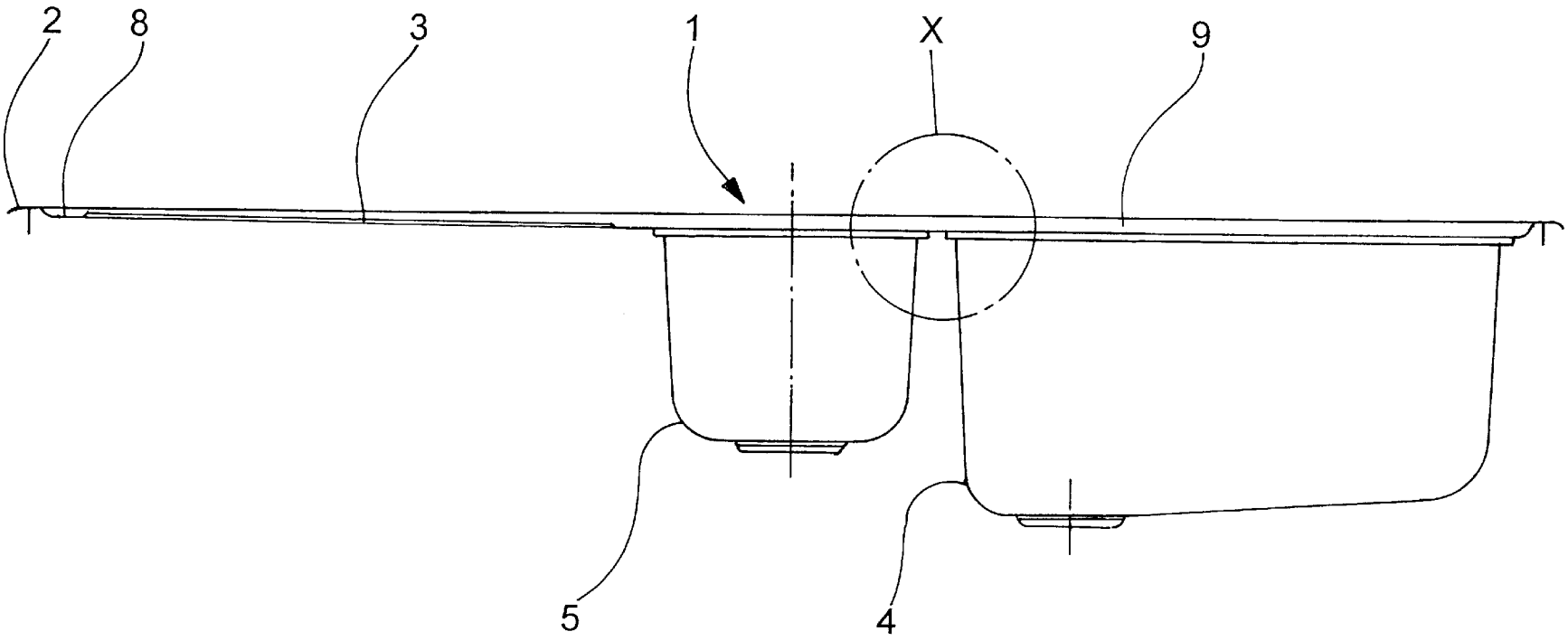
FIG. 1 shows a schematic longitudinal section through a built-in sink according to the invention.

The built-in sink designated as a whole with 1 at first gives the impression of a conventional construction. It has a surrounding elevated edge area 2, a likewise surrounding mirror area 8 set deeper with respect to the edge, a drip element 3, a large basin 4, and a smaller residual basin 5.

The surrounding edge area 2, the mirror area 8 and the drip element 3 are designated as a whole as the sink frame 9. In this sink frame, with conventional sink models, the two basins 4 and 5 are welded in, from which the disadvantages described at the beginning in greater detail result.

Figure 2:
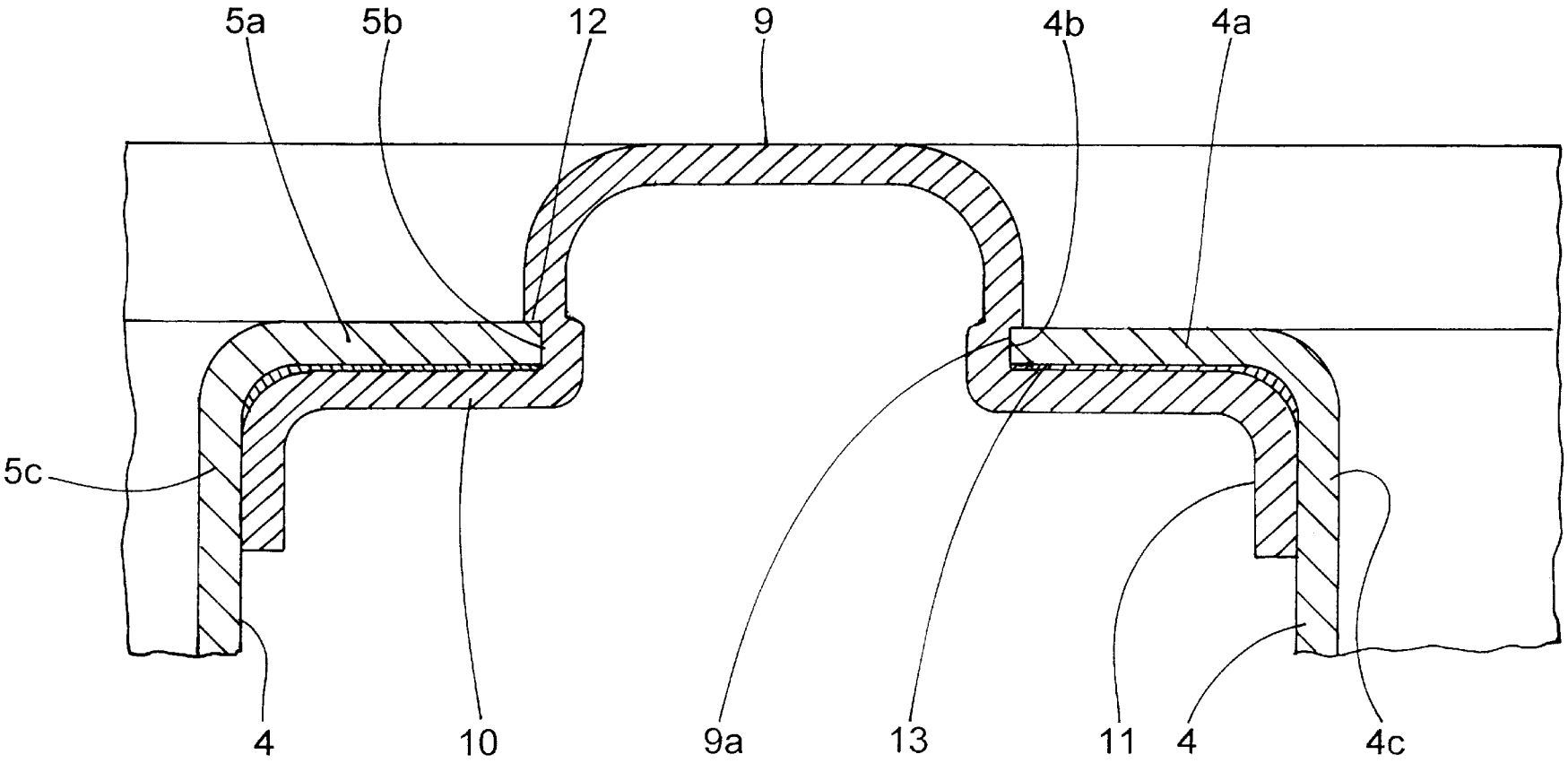
FIG. 2 shows the section marked with "X" in FIG. 1 on an enlarged scale.

The connection of the invention between the frame 9 and the basins 4 and 5 is depicted in FIG. 2. One recognizes that in a vertical area 9*a* of the frame 9, an undercut 12 is pressed in as basin retention stamping. The undercut 12 runs respectively along the external contour of the horizontally bent basin outer flange 4*a* or 5*a* and is positioned in relation to the undercut such that the outer edges 4*b*, 5*b* are snapped into the undercut 12 when the basin is pressed into the frame 9 from above such that the basin outer edge 4*b*, 5*b* is braced latchably from above in the surrounding undercut 12 of the frame 9.

Proceeding directly from the undercut 12, the frame 9 runs in a horizontally inward direction to the basin wall, so that it forms a supporting surface 10 for the above-positioned flange 4*a* or 5*a* of the basin 4 or 5. A centering flange 11 running approximately vertically downwardly is joined to this, which lies against the opposing basin wall 4*c*, 5*c*. The contact surfaces of frame and basin coming into engagement are so dimensioned such that the basin is guided horizontally as well as vertically into the undercut 12 after pressing in.

The pressing in accordance with the invention along overlapping connecting surfaces takes place in two areas in the embodiment: first, in the area of the undercut 12, where the outer edges 4*b* and 5*b* of the basin 4 or 5 have an oversize in relation to the vertical wall area 9*a* of the frame 9 corresponding with it; and second, between the centering flange 11 and the opposing wall section 4*c* or 5*c* of the basin 4 or 5 in that the centering flange 11 has a downwardly increasing undersize in relation to the outer contour of the basin wall in this area.

In order to guarantee an absolutely tight connection, an adhesive and sealing compound is positioned between the basin flange 4*a* or 5*a*, on the one hand, and the supporting wall 10, on the other, which is pressed together in the joining process between these two parts.

The area of the frame 9 running vertically upwardly from the basin wall appropriately serves additionally as a centering surface for accessories, perhaps for a scaffold board, a tableware basket, etc.

The manufacturing process of the sink of the invention is characterized by the following steps: first, the basin retention stamping in the form of a surrounding undercut zone is stamped into the conventionally preformed frame for each basin. This undercut zone preferably lies in a vertical wall area of the frame because the appearance will be more agreeable. After this, an opening is stamped in the frame for each basin, whereby however, the opening has a smaller open cross section than corresponds to the basin cross section. Subsequently, the supporting surface 10 with the centering flange 11 is stamped in. Now the two basins 4 and 5, which have been appropriately cut exactly to the desired contour on the basin edge are pressed in together with the adhesive and sealing compound 13 into the frame, whereupon the sink is finished.

In sum, the present invention offers the advantage that no after treatment in the connecting area is necessary, that logistics and storage are simplified, since various basins can be pressed in into the same frame, and that the bulge arising in the frame can be used for centering accessories.

It will be appreciated by those skilled in the art that changes could be made to the embodiment described above without departing from the broad inventive concept thereof. It is understood, therefore, that this invention is not limited to the particular embodiment disclosed, but it is intended to cover modifications within the spirit and scope of the present invention as defined by the appended claims.

We claim:

1. A metallic kitchen sink comprising an elevated, surrounding edge area which defines a frame (9), and at least one basin (4, 5), the frame (9) and the basin (4, 5) being prefabricated as separate parts which are adapted to be joined tightly together by at least one interference fit, wherein the frame (9) and the basin (4, 5) include connecting surfaces which are pressed together along surrounding overlapping areas of the connecting surfaces when said basin is fully mounted to said frame (9*a*, 4*b*, 5*b*; 11, 4*c* 5*c*), the at least one interference fit being formed by an undersize of the connecting surfaces (9*a*, 11) of the frame (9) in relation to the corresponding connecting surfaces (4*b*, 5*b*, 4*c*, 5*c*) of the basin (4,5).

2. The kitchen sink according to claim 1, wherein a plurality of connecting surfaces (9*a*, 11, 4*b*, 5*b*, 4*c*, 5*c*) are provided spaced from one another with the at least one interference fit being between the frame (9) and the basin (4, 5).

3. The kitchen sink according to claim 1, wherein the at least one interference fit is combined with undercut zones (12) in a connection area of one of the frame (9) and the basin (4, 5).

4. The kitchen sink according to claim 1, wherein the pressed together connecting surfaces (9*a*, 11; 4*b*, 5*b*, 4*c*, 5*c*) are oriented approximately vertically.

5. The kitchen sink according to claim 1, wherein the connecting surfaces are formed by an upper, approximately horizontal surrounding basin flange (4*a*, 5*a*) having an outer edge (4*b*, 5*b*) and a supporting surface (9*a*, 10) of the frame (9) enclosing the basin flange and the outer edge laterally and from underneath.

6. The kitchen sink according to claim 5, wherein at least the basin flange (4*a*, 5*a*) is braced with the outer edge (4*b*, 5*b*) in an interference fit with the frame (9).

7. The kitchen sink according to claim 5, wherein the supporting surface (10) of the frame (9) extends to a downwardly protruding centering flange (11) which is braced against a side wall (4*c*, 5*c*) of the basin (4, 5).

8. The kitchen sink according to claim 1, wherein the basin includes a basin flange (4*a*, 5*a*) having an outer edge (4*b*, 5*b*) which is braced latchably from above in at least one undercut (12) of the frame (9).

9. The kitchen sink according to claim 1, wherein the frame (9) is braced in at least one undercut of the basin (4, 5).

10. The kitchen sink according to claim 1, wherein at least one of a sealing compound and an adhesive compound is located in the overlapping areas of the frame (9) and the basin (4, 5).

11. The kitchen sink according to claim 10, wherein the at least one of the sealing and the adhesive compounds is pressed into the overlapping areas.

12. The kitchen sink according to claim 10, wherein the basin includes a and the frame includes a supporting surface, and at least one of the sealing and the adhesive compounds is located between the basin flange (4*a*, 5*a*) and the supporting surface (10).

13. A metallic kitchen sink comprising an elevated, surrounding edge area which defines a frame, and at least one basin, the frame and the basin being prefabricated as separate parts which are adapted to be joined tightly together by at least one interference fit, wherein the frame and the basin include connecting surfaces which extend continuously around an entire periphery of the basin which are pressed together along surrounding overlapping areas of the connecting surfaces, the connecting surface of the frame around the periphery of the basin being undersize in relation to the corresponding connecting surface of the basin to form the at least one interference fit.

14. A metallic kitchen sink comprising a frame having an elevated, surrounding edge area, and at least one basin, the frame and the basin being prefabricated as separate parts which are adapted to be joined tightly together by at least one interference fit, wherein the frame includes a basin receiving opening with a frame connecting surface being located around an entire periphery of the opening, the frame connecting surface including an undercut, and the basin includes a corresponding connecting surface which extends continuously around an entire periphery of the basin, the undercut of the frame connecting surface being undersize in relation to the corresponding connecting surface of the basin to form the at least one interference fit.

* * * * *